US007142790B2

(12) United States Patent
Takahashi

(10) Patent No.: US 7,142,790 B2
(45) Date of Patent: Nov. 28, 2006

(54) IMAGE-FORMING APPARATUS

(75) Inventor: Atsuya Takahashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 46 days.

(21) Appl. No.: 10/863,095

(22) Filed: Jun. 7, 2004

(65) Prior Publication Data

US 2004/0253010 A1 Dec. 16, 2004

(30) Foreign Application Priority Data

Jun. 12, 2003 (JP) ..... 2003-167799
May 25, 2004 (JP) ..... 2004-154839

(51) Int. Cl.
*G03G 15/00* (2006.01)

(52) U.S. Cl. ..... 399/16; 399/23

(58) Field of Classification Search ..... 399/16, 399/23, 389, 388; 271/9.05, 9.06
See application file for complete search history.

(56) References Cited

U.S. PATENT DOCUMENTS 4,647,239 A * 3/1987 Maezawa et al. ..... 400/708
5,019,839 A * 5/1991 Watanabe et al. ..... 346/134
5,167,461 A * 12/1992 Asama ..... 400/320
5,390,016 A * 2/1995 Hoshi et al. ..... 399/371
5,689,759 A * 11/1997 Isemura et al. ..... 399/45
6,158,909 A * 12/2000 McCue et al. ..... 400/582
6,179,499 B1 * 1/2001 Beretta et al. ..... 400/605
6,339,685 B1 * 1/2002 Okamoto et al. ..... 399/16
6,496,660 B1 * 12/2002 Takahashi et al. ..... 399/16
6,606,466 B1 * 8/2003 Sato ..... 399/82
6,778,787 B1 * 8/2004 Kinoshita et al. ..... 399/21
7,003,257 B1 * 2/2006 Yoshie et al. ..... 399/389

FOREIGN PATENT DOCUMENTS

JP 09-221254 A 8/1997

* cited by examiner

*Primary Examiner*—Anthony H. Nguyen
(74) *Attorney, Agent, or Firm*—Canon U.S.A. Inc. IP Division

(57) ABSTRACT

In an image-forming apparatus, a recording sheet passes in a first feeding path when it is determined that the size of the recording sheet does not satisfy the condition for feeding the recording sheet in a second feeding path even in a case in which the second feeding path is selected as the feeding path for the recording sheet.

18 Claims, 11 Drawing Sheets

FIG. 4

| PAGE ID | FD/FU DESIGNATION | SHEET-SUPPLY-PORT DESIGNATION | SHEET-SIZE DESIGNATION |
|---|---|---|---|
| 1 | FD | CASSETTE | A4 |
| 2 | FD | CASSETTE | A4 |
| 3 | FD | CASSETTE | A4 |
| 4 | FD | CASSETTE | A4 |
| 5 | FD | CASSETTE | UNIVERSAL |
| 6 | FD | CASSETTE | UNIVERSAL |
| 7 | FD | CASSETTE | UNIVERSAL |
| 8 | FD | CASSETTE | UNIVERSAL |
| 9 | FU | MP TRAY | A4 |
| 10 | FU | MP TRAY | A4 |

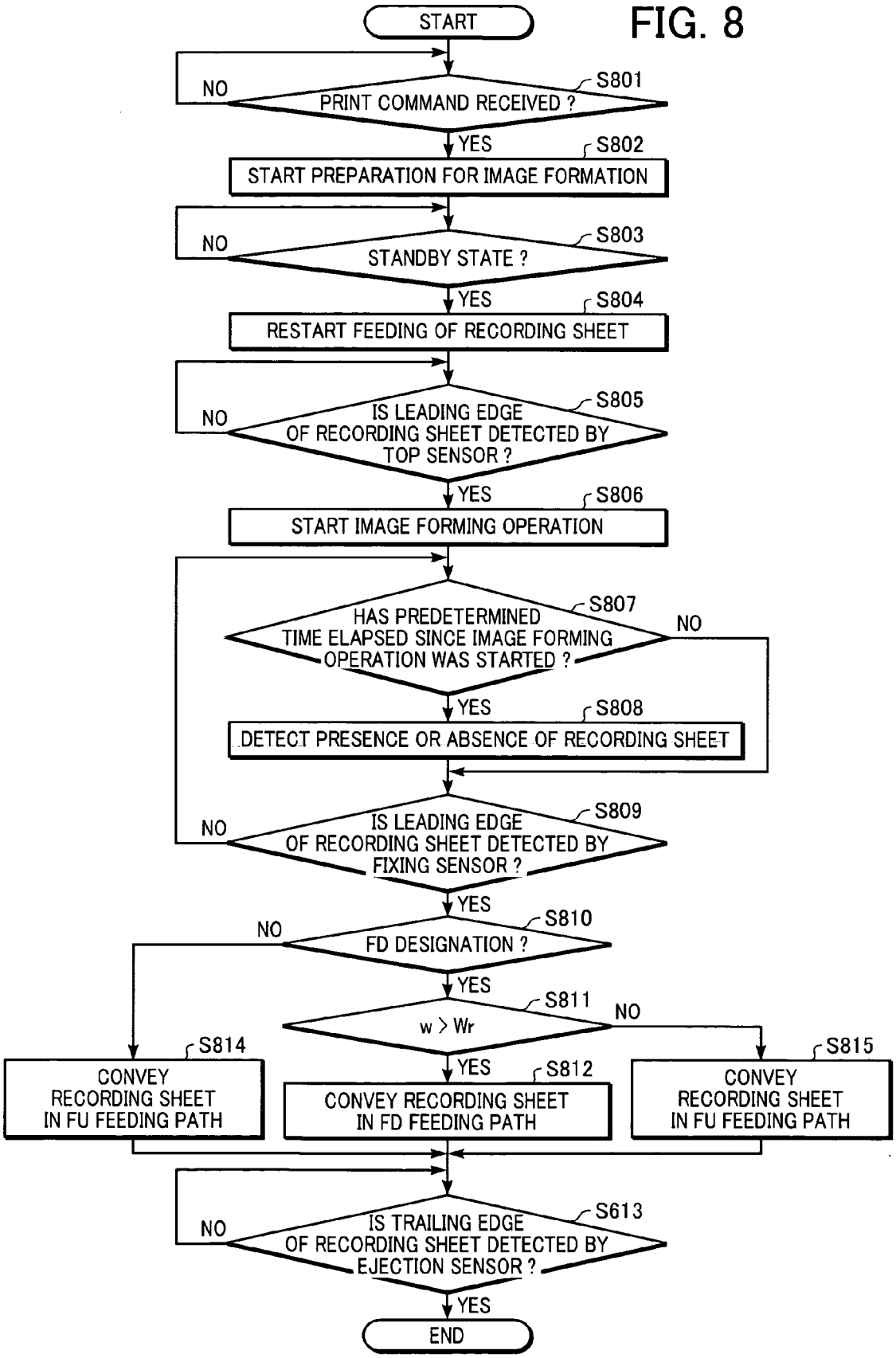
FIG. 8
START
S801
PRINT COMMAND RECEIVED ?
NO
YES
S802
START PREPARATION FOR IMAGE FORMATION
S803
STANDBY STATE ?
NO
YES
S804
RESTART FEEDING OF RECORDING SHEET
S805
IS LEADING EDGE OF RECORDING SHEET DETECTED BY TOP SENSOR ?
NO
YES
S806
START IMAGE FORMING OPERATION
S807
HAS PREDETERMINED TIME ELAPSED SINCE IMAGE FORMING OPERATION WAS STARTED ?
NO
YES
S808
DETECT PRESENCE OR ABSENCE OF RECORDING SHEET
S809
IS LEADING EDGE OF RECORDING SHEET DETECTED BY FIXING SENSOR ?
NO
YES
S810
FD DESIGNATION ?
NO
YES
S811
w > Wr
NO
YES
S814
CONVEY RECORDING SHEET IN FU FEEDING PATH
S812
CONVEY RECORDING SHEET IN FD FEEDING PATH
S815
CONVEY RECORDING SHEET IN FU FEEDING PATH
S613
IS TRAILING EDGE OF RECORDING SHEET DETECTED BY EJECTION SENSOR ?
NO
YES
END

IMAGE-FORMING APPARATUS

BACKGROUND OF THE INVENTION

1. Field of the Invention

The present invention relates to an image-forming apparatus.

2. Description of the Related Art

Image-forming apparatuses that form an image on a recording medium, for example, by electrophotography are known.

In particular, when a plurality of document images are successively copied onto recording media (recording sheets) in a small copying machine, in general, an image is formed on one side of each recording medium, and the recording medium is ejected with its image-bearing surface facing up (face-up) to an ejection tray provided on the side of the copying machine.

Such ejection in a face-up manner allows an image formed on the recording medium to be easily recognized. Moreover, since the ejecting section is not provided at the top of the copying machine, even when an image reading unit for reading document images is provided at the top, the total height of the machine can be reduced.

However, when a plurality of recording media are always printed in the original pager order and are ejected face-up, they are not finally stacked in that order on the ejection tray.

Accordingly, a copying machine has been proposed which has a reversing mechanism that allows a recording sheet to be ejected both in a face-up manner (with its image-bearing surface facing up) and in a face-down manner (with its image-bearing surface facing down) to an ejection tray provided on the side of the machine (for example, see Japanese Patent Laid-Open No. 09-221254).

In the above copying machine having the reversing mechanism, a feeding path through which a recording medium is reversed and ejected face down (hereinafter referred to as an "FD feeding path") is longer than a feeding path through which a recording medium is ejected face up without being reversed (hereinafter referred to as an "FU feeding path").

In the FD feeding path, the sheet-feeding direction of the recording medium must be switched to reverse the recording medium. In order to reduce the size of the machine, it is preferable that the number of feeding rollers provided in the FD feeding path to feed the recording medium be minimized.

However, when the number of feeding rollers in the FD feeding path is reduced, a recording medium having a length smaller than the distance between the feeding rollers may be jammed because it cannot be properly transferred between the feeding rollers.

Feeding members that constitute each feeding roller may be arranged with an interval W therebetween, as shown in FIG. 10, in order to reduce the cost (since the feeding members are not provided in the gap W, the cost is low). When such a feeding roller is used, the interval between the feeding members needs to be long to some extent in order to enhance the feeding ability for the recording medium. In this case, when the size (width) of a supplied recording sheet in the direction orthogonal to the sheet-feeding direction) is shorter than the interval W between the feeding members, the recording sheet cannot be properly conveyed, and paper jamming may occur.

SUMMARY OF THE INVENTION

In view of the above-described problems, an object of the present invention is to provide an image-forming apparatus in which a recording medium can pass through an adequate feeding path in accordance with the size thereof.

Another object of the present invention is to provide an image-forming apparatus in which a recording medium can pass through an adequate feeding path in accordance with the size thereof, that is, even in a case in which a first feeding path is designated by a feeding-path designating unit, when it is determined that the size of the recording medium is inadequate for feeding in the first feeding path, the recording medium is conveyed in a second feeding path.

In order to achieve the above objects, according to an aspect, the present invention provides an image-forming apparatus including an image-forming unit for forming an image on a recording medium, a first feeding path through which the recording medium from the image-forming unit passes, a second feeding path through which the recording medium from the image-forming unit passes, the second feeding path including at least one feeding unit having feeding members, a switching unit for switching between the first feeding path and the second feeding path to feed the recording medium, and a control unit for feeding the recording medium in the first feeding path depending on the relationship between a size of the recording medium in a direction orthogonal to a sheet-feeding direction and the interval between the feeding members even when the second feeding path is selected to feed the recording medium.

According to another aspect, the present invention provides an image-forming apparatus including an image-forming unit for forming an image on a recording medium, a first feeding path through which the recording medium from the image-forming unit passes, a second feeding path through which the recording medium from the image-forming unit passes, the second feeding path including a plurality of feeding units each having feeding members, a switching unit for switching between the first feeding path and the second feeding path to feed the recording medium, and a control unit for feeding the recording medium through the first feeding path depending on the relationship between a size of the recording medium in a direction orthogonal to a sheet-feeding direction and the intervals between the feeding members of the feeding units, and the relationship between a size of the recording medium in the sheet-feeding direction and the distance between the feeding units even when the second feeding path is selected to feed the recording medium.

According to a further aspect, the present invention provides an image-forming apparatus including an image-forming unit for forming an image on a recording medium, a feeding path through which the recording medium from the image-forming unit passes, a detecting unit for detecting a size of the recording medium in a direction orthogonal to a sheet-feeding direction, and a feeding unit provided in the feeding path and including a plurality of feeding members, wherein the detecting unit is positioned in accordance with the interval between the feeding members.

Further objects, features, and advantages of the present invention will become apparent from the following detailed description of the preferred embodiments with reference to the attached drawings.

BRIEF DESCRIPTION OF THE DRAWINGS

FIG. 4 is a table showing exemplary print information stored in a print-information memory unit of an engine controller in the main unit.

FIG. 8 is a flowchart showing the procedure for feeding a recording sheet in the second embodiment.

DESCRIPTION OF THE PREFERRED EMBODIMENTS

Embodiments of the present invention will be described in detail below with reference to the attached drawings. In the following embodiments, the present invention is applied to a laser beam printer as an example of an image-forming apparatus.

First Embodiment

Figure 1:
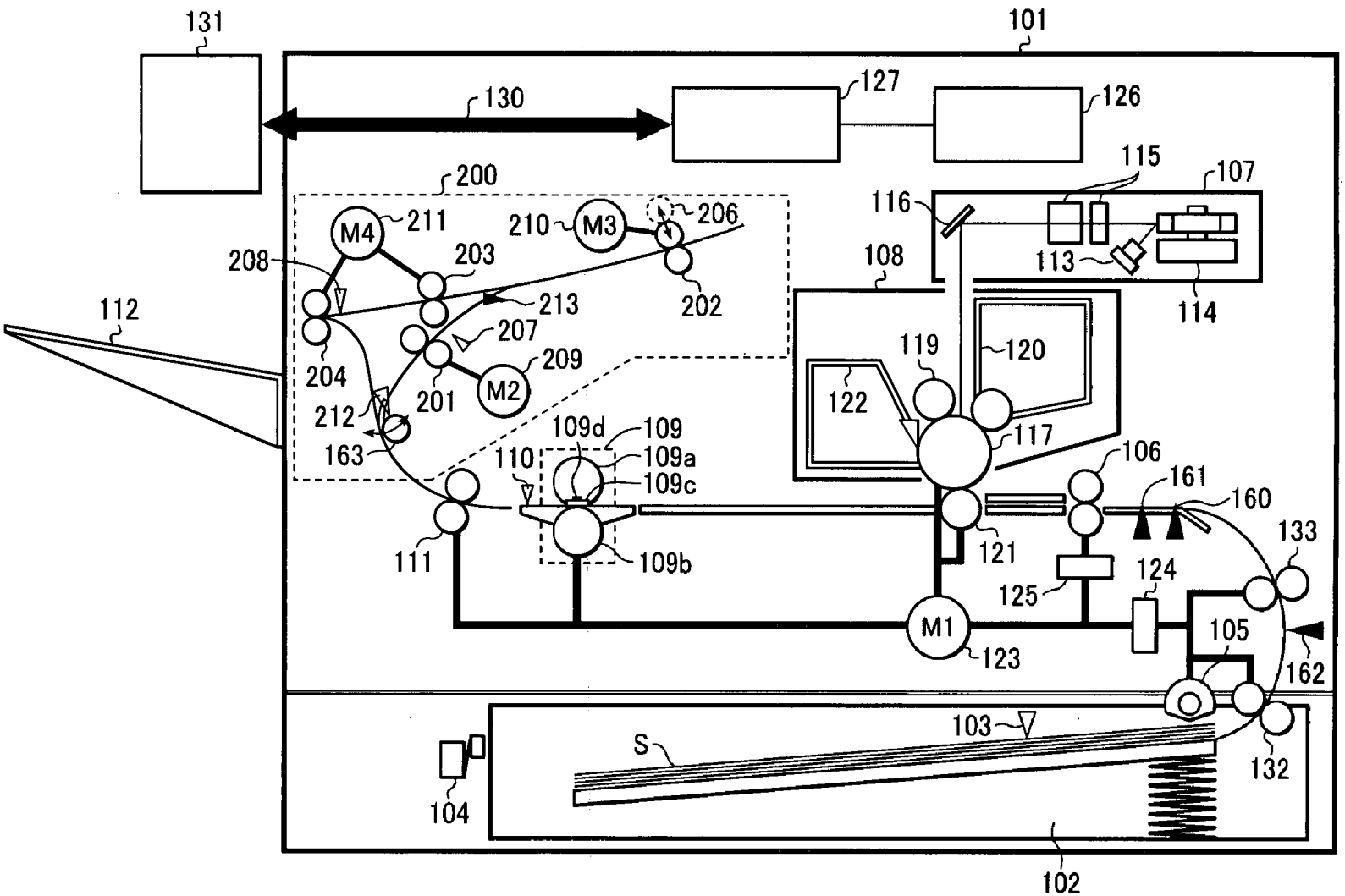
FIG. 1 is a cross-sectional view showing the configuration of a laser beam printer using an electrophotographic process according to a first embodiment of the present invention.

FIG. 1 is a cross-sectional view showing the configuration of a laser beam printer using an electrophotographic process.

A main unit 101 of a laser beam printer of the first embodiment includes a cassette 102 in which recording sheets S serving as recording media are stacked, a cassette paper-empty sensor 103 for detecting the presence or absence of the recording sheets S in the cassette 102, a cassette size sensor 104 constituted by a plurality of microswitches to detect the size of the recording sheets S in the cassette 102, a supply roller 105 for separating and supplying the recording sheets S one by one from the cassette 102, a feed roller 132 for feeding a recording sheet S supplied by the supply roller 105, and an intermediate roller 133.

A pair of resist rollers 106 feed a recording sheet S conveyed by the feed roller 132 and the intermediate roller 133.

A laser scanner 107 includes a laser unit 113 for emitting laser light modulated according to image signals (VDO signals) obtained by processing image information sent from an external apparatus 131, which will be described later, a polygon motor 114 for rotating a polygon mirror in order to scan the laser light from the laser unit 113 onto a photoconductive drum 117, which will be described later, an imaging lens 115 for focusing the laser light from the polygon mirror onto the photoconductive drum 117, and a reflecting mirror 116.

A cartridge 108 is provided on the downstream side in the sheet-feeding direction of the resist rollers 106 in order to form a toner image on a recording sheet S with laser light from the laser scanner 107. The cartridge 108 has a structure that allows an image to be formed on a recording sheet S by electrophotography, and includes a photoconductive drum 117, a primary charging roller 119 for uniformly charging the surface of the photoconductive drum 117, a developing unit 120 for developing a latent image, which is formed on the surface of the photoconductive drum 117 by exposure to laser light, with toner, a transfer roller 121 that applies a voltage having a polarity opposite to that of the toner from the back side of a recording sheet S, which is conveyed by the resist rollers 106, to the photoconductive drum 117 in order to transfer a toner image developed on the photoconductive drum 117 onto the recording sheet S, and a cleaner 122 for removing residual toner that is not transferred onto the recording sheet S by the transfer roller 121, but remains on the photoconductive drum 117.

A fixing unit 109 is provided on the downstream side in the sheet-feeding direction of the cartridge 108 to thermally fix a toner image formed on a recording sheet S. The fixing unit 109 includes a fixing film 109*a*, a pressure roller 109*b*, a ceramic heater 109*c* provided inside the fixing film 109*a* to heat the toner image on the recording sheet S, and a thermistor 109*d* for detecting the surface temperature of the ceramic heater 109*c*.

A fixing sensor 110 for detecting the presence or absence of a recording sheet S, a fixing roller 111 for ejecting a recording sheet S on which a toner image is fixed by the fixing unit 109, and a reversing unit 200 for ejecting a recording sheet S from the main unit 101 in a face-up (hereinafter abbreviated to FU) manner or a face-down (hereinafter abbreviated to FD) manner are provided on the downstream side in the sheet-feeding direction of the fixing unit 109.

A top sensor 160 is used to synchronize image exposure of the photoconductive drum 117 by the laser scanner 107 and feeding of a recording sheet S, and to measure the length in the sheet-feeding direction of the recording sheet S. A sheet-width sensor 161 detects the width of the recording sheet S (length in a direction orthogonal to the sheet-feeding direction). A prefeed sensor 162 detects a leading edge and a trailing edge of a recording sheet S supplied from the cassette 102 by the supply roller 105.

The configuration of the reversing unit 200 will now be described with reference to FIG. 2.

Figure 2:
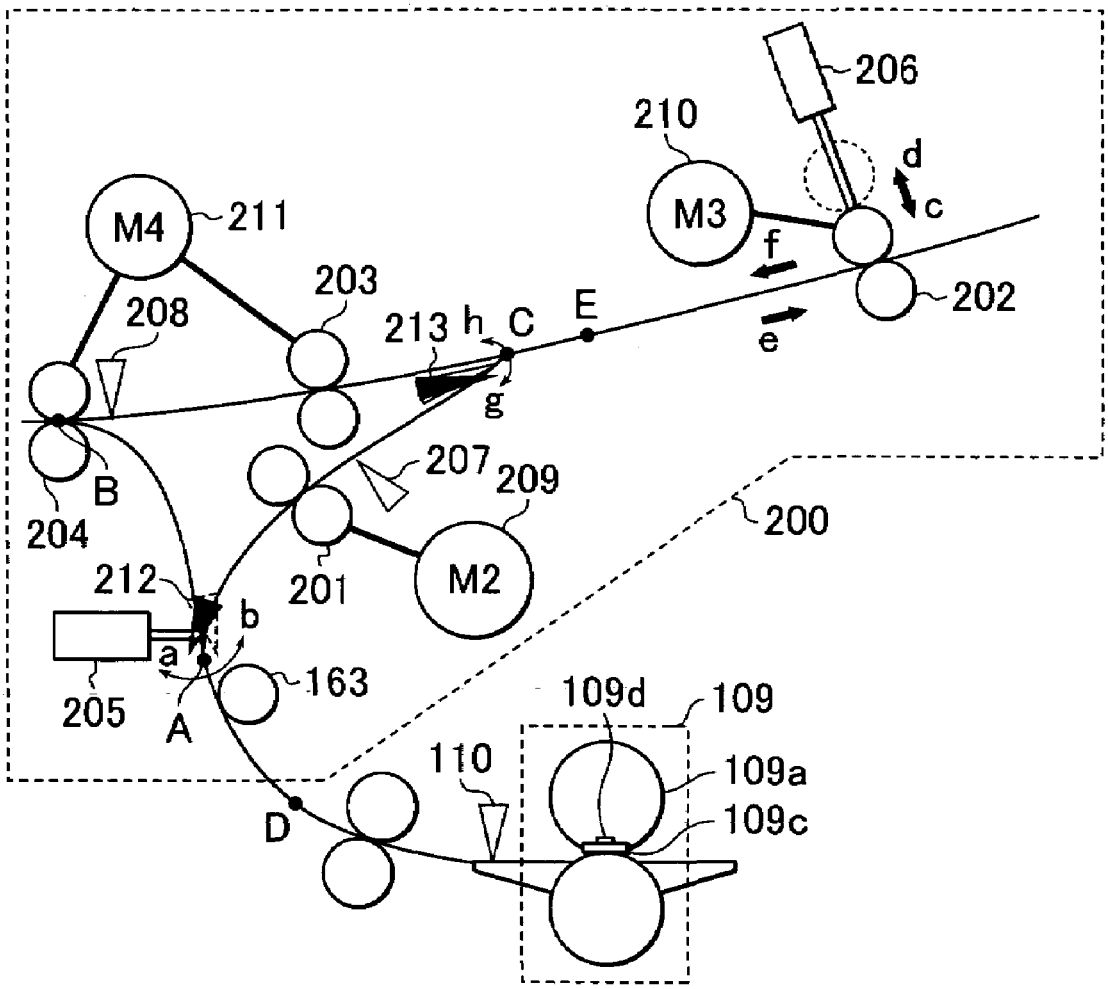
FIG. 2 is a cross-sectional view showing the configuration of a reversing unit in the laser beam printer.

FIG. 2 is a cross-sectional view showing the configuration of the reversing unit 200. The reversing unit 200 includes an FU feeding path serving as a first feeding path through which a recording sheet S passing through the fixing unit 109 with its image-bearing surface facing up is ejected to an ejection tray 112 via the points A and B in the face-up manner, and an FD feeding path serving as a second feeding path through which a recording sheet S passing through the fixing unit 109 with its image-bearing surface facing up is discharged to the ejection tray 112 with the image-bearing surface facing down via the points A, C, and B.

The reversing unit 200 also includes a driven roller 163, a junction roller 201 driven by a junction motor 209, a reverse roller 202 driven forward and in reverse by a reverse motor 210, an intermediate roller 203 driven by an ejection motor 211, an ejection roller 204 also driven by the ejection motor 211, an FD/FU switching flapper 212 for switching between the FU feeding path and the FD feeding path through which a recording sheet S is ejected to the ejection tray 112, an FD/FU switching solenoid 205 for switching the position of the leading edge of the FD/FU switching flapper 212 between a position "a" and a position "b" in FIG. 2, a separating solenoid 206 for switching the rollers constituting the reverse roller 202 between a contact position "c" and a separate position "d" in FIG. 2, a reverse sensor 207 provided on the downstream side in the sheet-feeding direction of the junction roller 201 between the points A and C on the FD feeding path so as to detect the presence or absence of a recording sheet S, and an ejection sensor 208 provided on the downstream side in the sheet-feeding direction of the intermediate roller 203 between the points C and B on the FD feeding path so as to detect the presence or absence of a recording sheet S.

The driven roller 163 is provided to reliably feed a recording sheet S to the point A, and does not receive a driving force from a motor or the like.

The leading end of a reverse flapper 213 is placed at a position "g" in FIG. 2 by a biasing force of a spring or the like when a recording sheet S does not pass, and is placed at a potion "h" by being pressed by a recording sheet S while the recording sheet S is passing therethrough. After the trailing edge of the recording sheet S passes, the leading end of the reverse flapper 213 is returned to the position "g" by a biasing force of the spring or the like. The reverse flapper 213 prevents a recording sheet S, which is to be conveyed from the point C to the point B, from being conveyed by mistake toward the point A.

The main unit also includes a main motor 123. The main motor 123 supplies a driving force to the components in the main unit 101, for example, to the supply roller 105, the feed roller 132, the intermediate roller 133, the resist rollers 106, the photoconductive drum 117, the primary charging roller 119, the transfer roller 121, the fixing unit 109, and the ejection roller 111.

The supply roller 105 and the resist rollers 106 do not constantly rotate while the main motor 123 is rotating. In order to feed a recording sheet S at a desired timing, the supply roller 105 and the resist rollers 106 are switched between a state in which a driving force from the main motor 123 is transmitted thereto and a state in which the driving force is not transmitted, by a supply roller clutch 124 and a resist-roller clutch 125 that are turned on and off under the control of an engine controller 126 which will be described later.

A control configuration of the main unit 101 will now be described with reference to FIG. 3.

Figure 3:
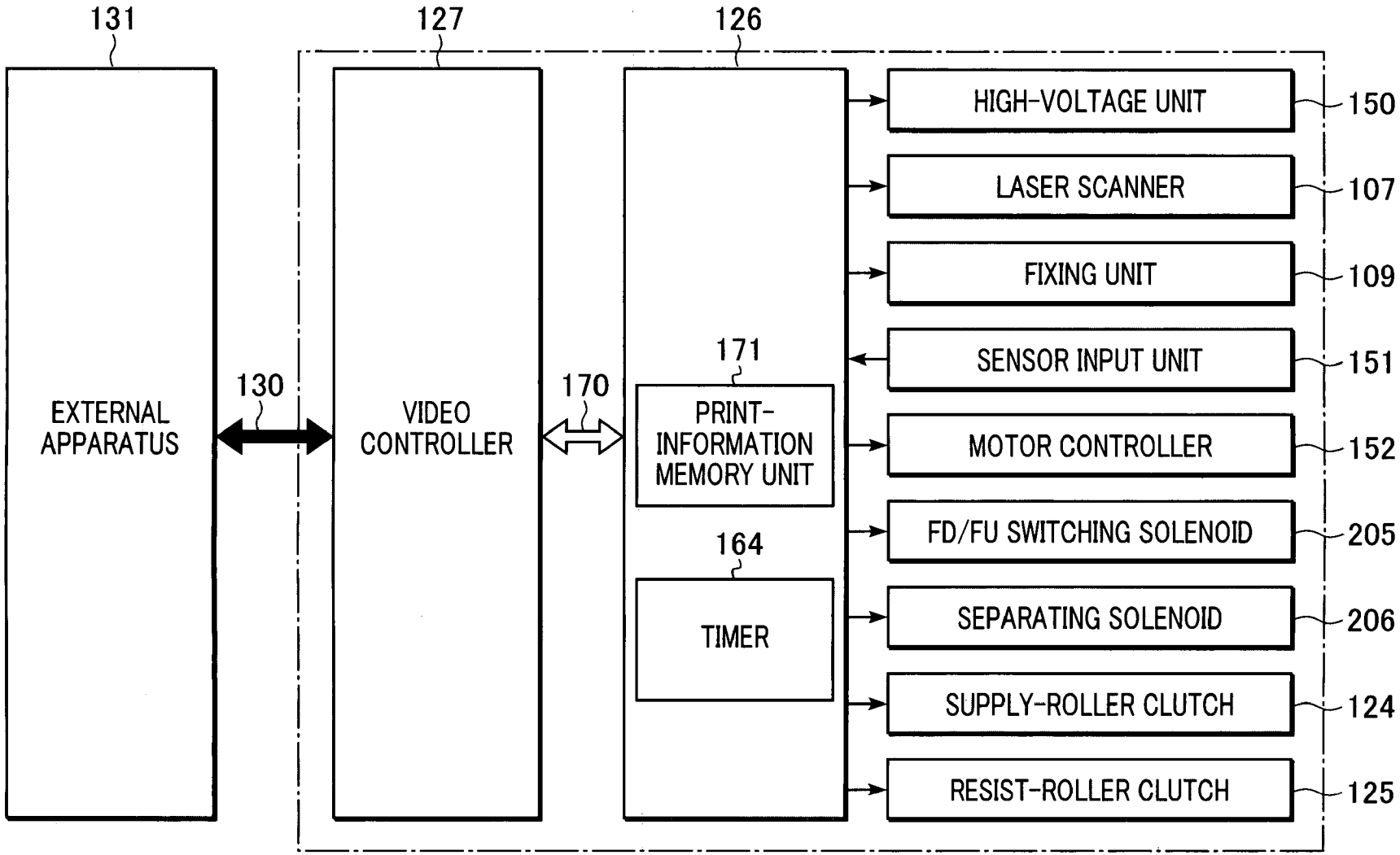
FIG. 3 is a block diagram showing a control system in a main unit of the laser beam printer.

FIG. 3 is a block diagram showing the control configuration in the main unit 101.

An external apparatus, such as a personal computer, 131 sends image information about images to be printed together with print information (ex., information about the size of recording sheets S, the designated paper cassette, and the necessity for double-sided printing) to the main unit 101 through a general-purpose interface 130 (ex., Centronics or RS232C).

A video controller 127 processes the image information sent from the external apparatus 131 into bit-data image signals (VDO signals), and sends the VDO signals to an engine controller 126 through a video interface 170. The engine controller 126 controls the components in the main unit 101.

A high-voltage unit 150 generates high voltages such as a charging bias (voltage) to be applied to the primary charging roller 119, a developing bias to be applied to a developing roller in the developing unit 120, and a transfer bias to be applied to the transfer roller 121.

The engine controller 126 also controls the amount of light emitted from the laser unit 113 in the laser scanner 107 and the rotating speed of the polygon motor 114.

The engine controller 126 also gives instructions to a motor controller 152 for controlling various motors such as the main motor 123 that drives the supply roller 105 and so on for feeding recording sheets S, the junction motor 209 that drives the junction roller 201, the reverse motor 210 that drives the reverse roller 202, and the ejection motor 211 that drives the intermediate roller 203 and the ejection roller 204.

The engine controller 126 sends an H/L signal to the FU/FD switching solenoid 205 and the separating solenoid 206 in order to turn the solenoids on and off.

The engine controller 126 includes a print-information memory unit 171 that stores the above-described print information input from the external apparatus 131 through the video controller 127 and print information designated by the video controller 127.

Exemplary print information stored in the print-information memory unit 171 will now be described with reference to FIG. 4.

FIG. 4 is a table showing exemplary print information stored in the print-information memory unit 171 of the engine controller 126.

The external apparatus 131 sends image information about images to be printed, and print information about an image on each of a plurality of pages to the video controller 127 of the main unit 101. As shown in FIG. 4, print information includes, for example, an FD/FU designation that determines whether a recording sheet corresponding to each of the pages (page ID No. 1 to 10) is ejected to the ejection tray 112 with its image-bearing surface facing down (FD) through the FD feeding path or with its image-bearing surface facing up (FU) through the FU feeding path, and a designation of a sheet supply port through which recording sheets are supplied, and a sheet-size designation indicating the size of recording sheets.

Cassettes and an MP tray are shown as sheet supply ports that are selected by a sheet supply port designation in FIG. 4. An MP tray refers to a sheet supply port (not shown) provided on the right side of the main unit 101 to supply recording sheets therefrom.

The universal size selected by a sheet-size designation refers to the size of a recording medium on which images are formed, other than the standard sizes such as A3-, A4-, B4-, and B5-sizes. When the universal size is designated as the sheet size, for example, the engine controller 126 determines that a designated recording medium has the largest possible size that can be fed in the main unit 101, and sets the timings for sheet supply and feeding.

Print information sent to the engine controller 126 through the video controller 127 is stored in the print-information memory unit 171. The engine controller 126 performs image formation on each page according to the print information stored in the print-information memory unit 171. For example, for the first page, a recording sheet is supplied from the cassette 102 in which A4-size recording sheets are stacked, and is ejected to the ejection tray 112 with its image-bearing surface facing down (FD) through the FD feeding path after an image is formed thereon by the fixing unit 109. In FIG. 4, page ID numbers are given to 1 to 10 pages. After image formation on the first one of the ten pages is completed, print information about a new page is stored. The number of pages stored in the print-information memory unit 171 is not limited to ten, and, of course, the number may be determined arbitrarily.

In the main unit 101 of the laser beam printer having the above-described configuration, a recording sheet S cannot be normally conveyed, depending on the relationship between the size (length) d in the sheet-feeding direction of the recording sheet S and the distances between the rollers in the FD feeding path from the point A to the point B through the point E in the reversing unit 200.

Figure 5:
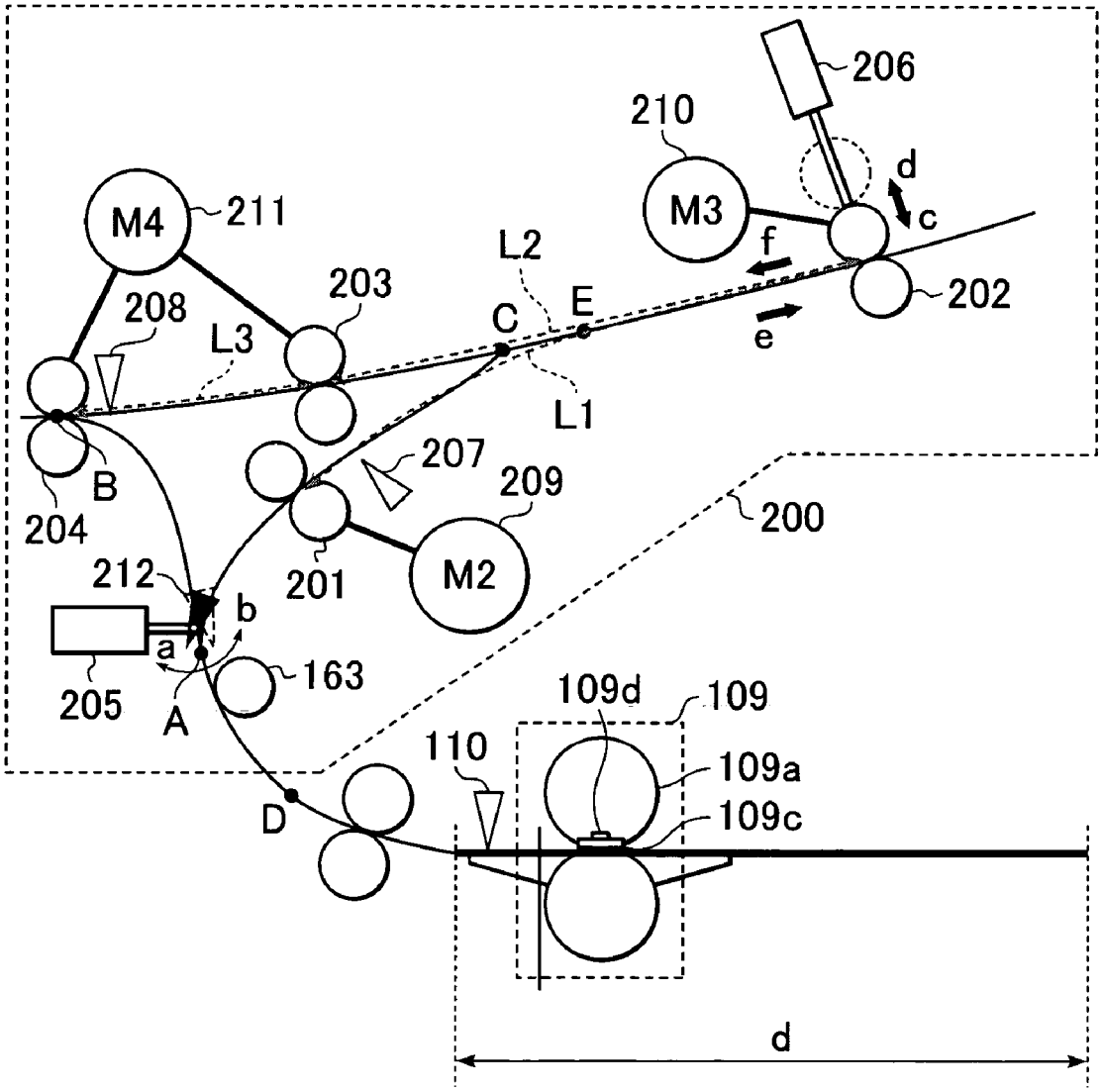
FIG. 5 is an explanatory view showing the positional relationship among rollers in the reversing unit.

This problem will be described with reference to FIG. 5. FIG. 5 is a schematic view showing the positional relationships among the rollers in the reversing unit 200.

In FIG. 5, d represents the size (length) in the sheet-feeding direction of a recording sheet S, L1 represents the distance between the junction roller 201 and the reverse roller 202 in the feeding path, L2 represents the distance between the reverse roller 202 and the intermediate roller 203, and L3 represents the distance between the intermediate roller 203 and the ejection roller 204.

When the FD feeding path is selected as the feeding path for the recording sheet S, the junction roller 201, the reverse roller 202, the intermediate roller 203, and the ejection roller 204 convey the recording sheet S.

When the size d in the sheet-feeding direction of the recording sheet S to be conveyed through the FD feeding path is smaller than any of the distances L1, L2, and L3 between the rollers, the recording sheet S cannot be transferred between the rollers, and cannot be conveyed through the FD feeding path.

For example, in a case in which the distances L1, L2, and L3 between the rollers have a relationship L1>L2>L3, when the size d of the recording sheet S is shorter than L1, the recording sheet S is not conveyed between the reverse roller 202 and the intermediate roller 203 because it does not receive a feeding force from any of the rollers.

Accordingly, it is possible to determine whether a recording sheet S has a size such as to be conveyed through the FD feeding path by comparing the longest distance between the rollers in the FD feeding path prestored in the engine controller 126 and the actual size of the recording sheet S.

In such a method, if the size d is not sufficient to feed the recording sheet S through the FD feeding path, even when the FD feeding path is designated in the print information, a change is made to eject the recording sheet S through the FU feeding path. This prevents the recording sheet S from being jammed in the main unit 101.

An operation for feeding a recording sheet S in the first embodiment will be described below with reference to FIG. 6.

Figure 6:
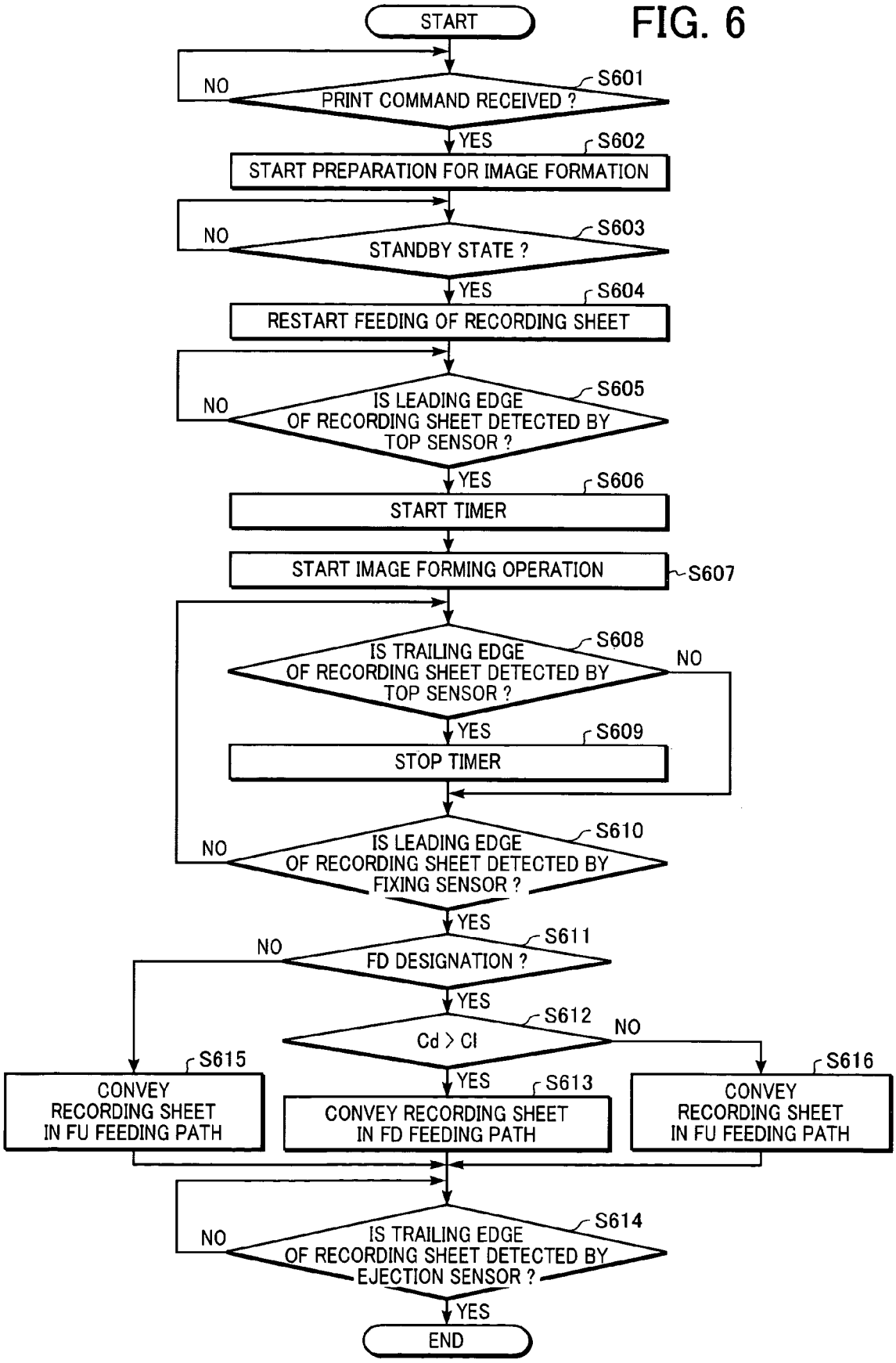
FIG. 6 is a flowchart showing the procedure for feeding a recording sheet.

FIG. 6 is a flowchart showing the feeding operation for a recording sheet S. In the following description, for example, a recording sheet S to be fed corresponds to a page ID number 5 having a universal size.

In Step S601, the engine controller 126 determines whether a print command to start image formation on a recording sheet S is received from the video controller 127. The video controller 127 sends print information, such as a sheet-size designation of the size of the recording sheet S, a sheet supply port designation, for example, of a cassette as a sheet supply port from which the recording sheet S is supplied, and an FD/FU designation concerning whether the recording sheet S should be conveyed through the FD feeding path or the FU feeding path, and then sends a print command together with signals corresponding to images to be printed, in response to a print request from the external apparatus 131.

When the engine controller 126 determines in Step S601 that the print command is received, Step S602 is performed.

In Step S602, the engine controller 126 starts to make preparation for image formation on the recording sheet S. More specifically, the main motor 123 is rotated, and a charging bias (voltage) is applied from the high-voltage unit 150 to the primary charging roller 119 so that the surface potential of the photoconductive drum 117 becomes uniform. The engine controller 126 also starts other preparatory operations for image formation. In Step S602, one of the recording sheets S stacked in the cassette 102 is supplied by giving one turn to the supply roller 105, and the feed roller 132 and the intermediate roller 133 are stopped when the prefeed sensor 162 detects the recording sheet S.

In Step S603, the engine controller 126 determines whether the preparatory operations for image formation are completed and the main unit 101 is brought into a standby state in which it is ready for image formation. When the main unit 101 is in the standby state, in Step S604, the engine controller 126 turns the supply roller clutch 124 on to transmit the driving force of the main motor 123 to the feed roller 132 and the intermediate roller 133, thus restarting the feeding of the recording sheet S.

In Step S605, the engine controller 126 monitors a signal input from the top sensor 160 through a sensor input unit 151 shown in FIG. 3, and determines whether the top sensor 160 detects the leading edge of the recording sheet S. When the leading edge of the recording sheet S is detected, Step S606 is performed.

In Step S606, the engine controller 126 starts a timer 164 shown in FIG. 3 in order to measure the length of the recording sheet S in the sheet-feeding direction.

In Step S607, the engine controller 126 starts an image-forming operation for the recording sheet S. The image-forming operation is performed in the following procedure. First, the surface of the photoconductive drum 117 is uniformly charged by applying a charging bias to the primary charging roller 119, and an electrostatic latent image is formed by exposing the photoconductive drum 117 to laser light that is emitted from the laser scanner 107 according to image signals corresponding to a page to be printed. The electrostatic latent image on the photoconductive drum 117 is developed by the developing unit 120 to form a toner image. Subsequently, a transfer bias voltage having a polarity opposite to that of the toner is applied to the transfer roller 121, thereby forming a toner image on the recording sheet S. Furthermore, in order to thermally fix the toner image on the recording sheet S, the fixing film 109*a* and the pressure roller 109*b* are rotated while maintaining a predetermined temperature of the ceramic heater 108*c* in the fixing unit 109 on the basis of the temperature detected by the thermistor 109*d*.

In Step S608, the engine controller 126 monitors a signal input from the top sensor 160 through the sensor input unit 151, and determines whether the top sensor 160 detects the trailing edge of the recording sheet S. When the top sensor 160 detects the trailing edge of the recording sheet S, Step S609 is performed. When the top sensor 160 does not detect the trailing edge, Step S610 is performed.

In Step S609, the engine controller 126 stops the counting operation with the timer 164 the moment the top sensor 160 detects the trailing edge of the recording sheet S.

A value Cd counted by the timer 164 during the counting operation from Step S606 to Step S609 is stored as a count value indicating the size d of the recording sheet S in the sheet-feeding direction in a memory (not shown) in the engine controller 126.

In Step S610, the engine controller 126 monitors a signal input from the ejection sensor 208 through the sensor input unit 151, and determines whether the ejection sensor 208 detects the leading edge of the recording sheet S. When the ejection sensor 208 detects the leading edge of the recording sheet S, Step S611 is performed. When the ejection sensor 208 does not detect the leading edge, Step S608 is performed again.

In Step S611, the engine controller 126 determines whether an FD designation or an FU designation is stored as print information about the recording sheet S in the print-information memory unit 171. When an FD designation is stored, Step S612 is performed. When an FU designation is stored, Step S615 is performed.

When the FD feeding path is selected as the feeding path for the recording sheet S, the engine controller 126 determines in Step S612 whether the count value Cd stored corresponding to the size d of the recording sheet S in the sheet-feeding direction in the memory in Step S609 is larger than a count value C1 prestored in the memory of the engine controller 126. The prestored count value C1 corresponds to the longest one of the distances between the rollers provided in the FD feeding path. In the configuration of the reversing unit 200 in FIG. 5, the distance L1 between the junction roller 201 and the reverse roller 202 in the FD feeding path is the longest, that is, longer than the distance L2 between the reverse roller 202 and the intermediate roller 203 and the distance L3 between the intermediate roller 203 and the ejection roller 204. Therefore, in this configuration, the count value C1 corresponding to the distance L1 is stored in the memory of the engine controller 126.

When the engine controller 126 determines in Step S612 that the count value Cd corresponding to the length of the recording sheet S in the sheet-feeding direction measured by the timer 164 is larger than the count value C1 corresponding to the distance L1 between the junction roller 201 and the reverse roller 202, Step S613 is performed. When the engine controller 126 determines that the count value Cd is smaller than or equal to the count value C1, Step S616 is performed.

When the length of the recording sheet S satisfies the condition for feeding the recording sheet S in the FD feeding path, in Step S613, the engine controller 126 controls the FD/FU switching solenoid 205 to place the FD/FU switching flapper 212 at the position "a" in FIG. 2, and feeds the recording sheet S in the FD feeding path. After the recording sheet S is put in the FD feeding path, the junction roller 201 starts to rotate, and the leading edge of the recording sheet S is detected by the reverse sensor 207. After the leading edge of the recording sheet S is detected by the reverse sensor 207, the reverse roller 202 starts to rotate so that the recording sheet S is transferred from the junction roller 201 to the reverse roller 202. In synchronization with the detection of the trailing edge of the recording sheet S by the reverse sensor 207, the driving of the reverse roller 202 is temporarily stopped so that the trailing edge of the recording sheet S is placed at the point E, the feeding direction of the recording sheet S is switched from the e-direction to the opposite f-direction, and the recording sheet S is switched back.

When the length of the recording sheet S is shorter than the size that can be conveyed through the FD feeding path, in Step S616, the engine controller 126 controls the FD/FU switching solenoid 205 to place the FD/FU switching flapper 212 at the position "b" in FIG. 2, and the recording sheet S is conveyed in the FU feeding path. Step S616 is performed only when the recording sheet S is conveyed through the FU feeding path although the FD feeding path is selected as the feeding path for the recording sheet S. Therefore, it is preferable that the engine controller 126 send, to the video controller 127, information indicating that the size d of the recording sheet S in the sheet-feeding direction does not match the main unit 101, that is, does not match the designated feeding path. The video controller 127 can inform the user that the size of the recording sheet S is inadequate, by displaying the information on a control panel (not shown) connected thereto or on a display screen of the external apparatus 131. In this case, the user can recognize that the size of the recording sheet S is inadequate, and can perform an image-forming operation again after checking the length of the recording sheet S in the sheet-feeding direction as necessary. Such information indicating that the length of the recording sheet S does not match the main unit 101, that is, does not match the designated feeding path may be transmitted to the video controller 127 or the like only in special cases, for example, when an ejection apparatus, such as a stapler, is connected to the main unit 101, instead of the ejection tray 112, and when trouble occurs while a plurality of recording sheets S are successively printed.

The above-described information transmission to the user can prevent, for example; the following two problems:

(1) When an ejection apparatus having a stapler is connected to the main unit 101, instead of the ejection tray 112, recording sheets that should be ejected in a face-down manner may be ejected in a face-up manner because the size of the recording sheets does not match the selected feeding path. In this case, the recording sheets are stapled with their image-bearing surfaces facing on the side different from the designated side.

(2) When a plurality of recording sheets S are successively printed, while the preceding recording sheet S1 is passing in the FD feeding path, a succeeding recording sheet S2 that should pass in the FD feeding path passes in the FU feeding path. Consequently, the succeeding recording sheet S2 may be ejected to the ejection tray 112 earlier than the preceding recording sheet S1. In such a case, the recording sheets are stacked in the ejection tray 112 in the wrong page order.

As described above, the recording sheet S passes through the FD feeding path or the FU feeding path in Step S613, S615, or S616, and is ejected to the ejection tray 112 by the ejection roller 204.

In Step S614, the engine controller 126 monitors a signal input from the ejection sensor 208 through the sensor input unit 151, and determines whether the ejection sensor 208 detects the trailing edge of the recording sheet S. When the ejection sensor 208 detects the trailing edge of the recording sheet S, it is determined that the recording sheet S is ejected to the ejection tray 112, and the feeding operation for the recording sheet S is completed.

As described above, in the first embodiment, even in a case in which the FD feeding path is designated for the recording sheet, when the size (length) of the recording sheet in the sheet-feeding direction is shorter than the longest distance between the rollers in the FD feeding path, the recording sheet is conveyed in the FU feeding path. Therefore, it is possible to prevent the user from being troubled by jamming of the recording sheet between the rollers, for example, to eliminate the necessity of removing a jammed recording sheet.

It is also possible to precisely inform the user that the size of the recording sheet in the sheet-feeding direction does not match the main unit 101, that is, does not match the designated feeding path.

It is further possible to prevent recording sheets from being stapled with their image-bearing surfaces facing on an undesired side when an ejection apparatus having a stapler is connected to the main unit 101.

Second Embodiment

A second embodiment of the present invention will now be described.

In the above-described first embodiment, the engine controller 126 measures the length of the recording sheet S in the sheet-feeding direction on the basis of the result of detection by the top sensor 160. Even in a case in which the FD feeding path is designated as the feeding path for the recording sheet S, when the length of the recording sheet S is shorter than the longest one of the distances between the rollers in the FD feeding path, the recording sheet S is conveyed in the FU feeding path.

In contrast, in the second embodiment, an engine controller 126 measures the width of a recording sheet S in the direction orthogonal to the sheet-feeding direction. Even in a case in which the FD feeding path is designated for the recording sheet, when the width of the recording sheet is shorter than the longest one of the intervals between the roller members of the feeding rollers provided in the FD feeding path, the recording sheet is conveyed in the FU feeding path.

Since the second embodiment adopts a main unit 101 having the configuration shown in FIG. 1, in a manner similar to that in the first embodiment, a description of the configuration is omitted. In the second embodiment, the size (width) of a recording sheet S in the direction orthogonal to the sheet-feeding direction is measured with a sheet-width sensor 161 shown in FIG. 1.

Figure 7:
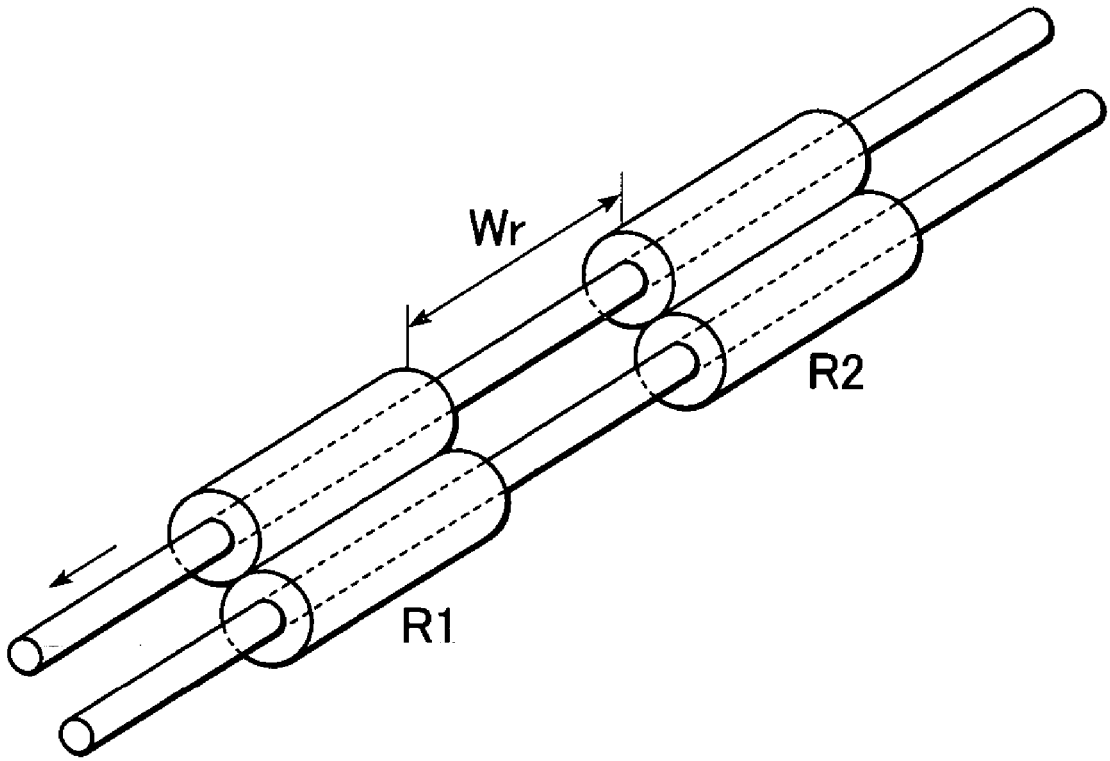
FIG. 7 is a perspective view showing the structure of a feeding roller provided in an FD feeding path of the reversing unit in a second embodiment of the present invention.

FIG. 7 is a perspective view showing the structure of a junction roller 201, a reverse roller 202, an intermediate roller 203, and an ejection roller 204 provided in an FD feeding path in a reversing unit 200 to constitute a feeding section. In FIG. 7, Wr represents the interval in the direction shown by the arrow between roller members R1 and roller members R2 serving as feeding members that are provided in each roller to rotate in contact with a recording sheet S. The roller members R1 and R2 are arranged on the roller shafts with a predetermined distance Wr therebetween.

The structure of the rollers is determined in consideration of the cost of the rollers and the feeding ability for recording sheets. In order to reduce the cost of the rollers, it is possible to construct the feeding members, as shown in FIG. 7. In the structure shown in FIG. 7, the size of the feeding members and the interval between the feeding members are determined in consideration of the feeding ability for recording sheets. In a feeding roller constituted by two pairs of feeing members, as shown in FIG. 7, experiments have proved that it is preferable, in order to increase the feeding ability, that the interval between the feeding members be reasonably long. In particular, in the second embodiment, the interval in the reverse roller 202 is wider than the intervals in the junction roller 201, the intermediate roller 203, and the ejection roller 204 in the FD feeding path of the reversing unit 200. Since the reverse roller 202 operates to temporarily stop and reverse the recording sheet S, it is different from the other feeding rollers in the rotating motion and the behavior of a recording sheet to be conveyed thereby. For this reason, the reverse roller 202 must have a more stable feeding ability than in the other feeding rollers in order to minimize sheet slipping and wrinkling.

While an example of a roller is shown in FIG. 7, the intervals in the junction roller 201, the reverse roller 202, the intermediate roller 203, and the ejection roller 204 are respectively set at Wr1, Wr2, Wr3, and Wr4.

In the laser beam printer main unit 101 having the above configuration, a recording sheet S cannot be normally conveyed, depending on the relationship between the size (width) w of the recording sheet S in the direction orthogonal to the sheet-feeding direction and the intervals Wr1 to Wr4.

That is, when the width w of a recording sheet, which is to be fed in the FD feeding path, in the direction orthogonal to the sheet-feeding direction is shorter than any one of the intervals Wr1 to Wr4, the recording sheet stays between the roller members R1 and R2, and is not conveyed in the FD feeding path.

For example, in a case in which Wr1 to Wr4 have the relationship Wr2>Wr1 >Wr3>Wr4, when the width w of a recording sheet in the direction orthogonal to the sheet-feeding direction is shorter than Wr2, the recording sheet stays at the junction roller 201, and feeding failure occurs.

Accordingly, it is possible to determine whether the width of a recording sheet satisfies the condition for feeding the recording sheet in the FD feeding path, by comparing the longest interval Wr in the FD feeding path previously stored in the engine controller 126 and the actual width of the recording sheet.

In such a method, in a case in which the width w of the recording sheet does not satisfy the condition for feeding the recording sheet in the FD feeding path, even when the FD feeding path is designated in print information, the recording sheet is ejected through the FU feeding path. This prevents the recording sheet from being jammed in the main unit 101.

An operation for feeding a recording sheet in the second embodiment will be described below with reference to FIG. 8.

FIG. 8 is a flowchart showing a procedure for feeding a recording sheet S. In the following description, a recording sheet S to be fed corresponds to a page ID number 5 having a universal size.

Since Steps S801 to S805 are similar to Steps S601 to S605 in the first embodiment, descriptions thereof are omitted.

In Step S806, the engine controller 126 starts an image-forming operation for a recording sheet S. The image-forming operation is performed in the following procedure. First, the surface of a photoconductive drum 117 is uniformly charged by applying a charging bias to a primary charging roller 119, and an electrostatic latent image is formed by exposing the photoconductive drum 117 to laser light that is emitted from a laser scanner 107 according to image signals corresponding to a page to be printed. The electrostatic latent image on the photoconductive drum 117 is developed by a developing unit 120 to form a toner image. Subsequently, a transfer bias voltage having a polarity opposite to that of the toner is applied to a transfer roller 121, thereby forming a toner image on the recording sheet S. Furthermore, in order to thermally fix the toner image on the recording sheet S, a fixing film 109*a* and a pressure roller 109*b* are rotated while maintaining a predetermined temperature of a ceramic heater 108*c* in a fixing unit 109 on the basis of the temperature detected by a thermistor 109*d*.

In Step S807, the engine controller 126 determines with a timer 164 whether a predetermined time has elapsed since the image-forming operation was started in Step S806. When the predetermined time has elapsed, Step S808 is performed. The predetermined time refers to the sum of the time taken from when the leading edge of the recording sheet S is detected by a top sensor 160 and until when the leading edge of the recording sheet S reaches the sheet-width sensor 161, and a predetermined margin, that is, the time necessary for the sheet-width sensor 161 to reliably detect the leading edge of the recording sheet S.

In Step S808, the engine controller 126 checks whether the recording sheet S is detected by the sheet-width sensor 161, and stores the detection result by the sheet-width sensor 161 in an internal memory (not shown).

Figure 9A:
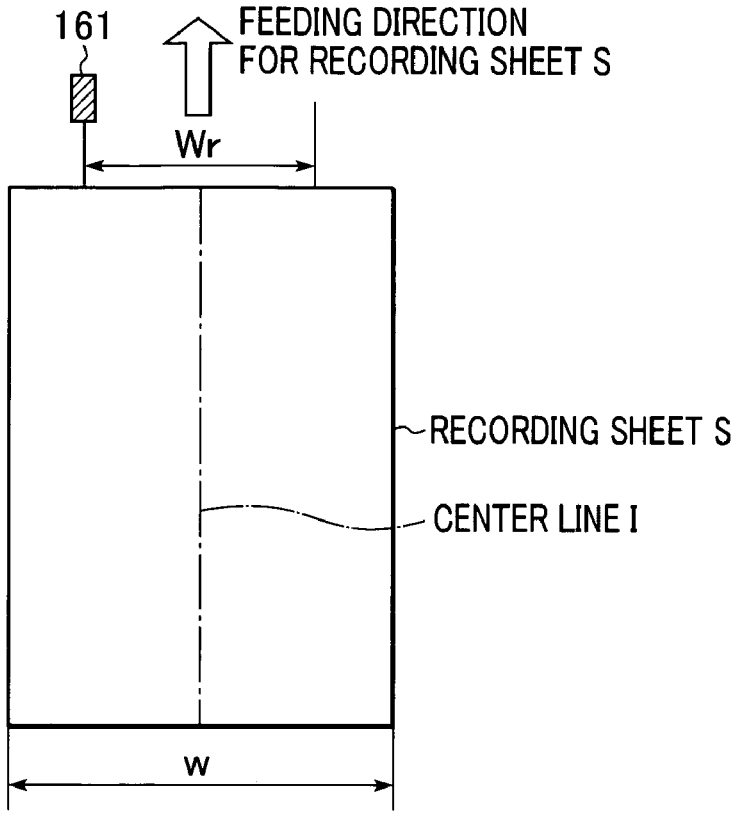
FIGS. 9A and 9B are explanatory views showing the positional relationship between a recording sheet and a sheet-width sensor.
Figure 9B:
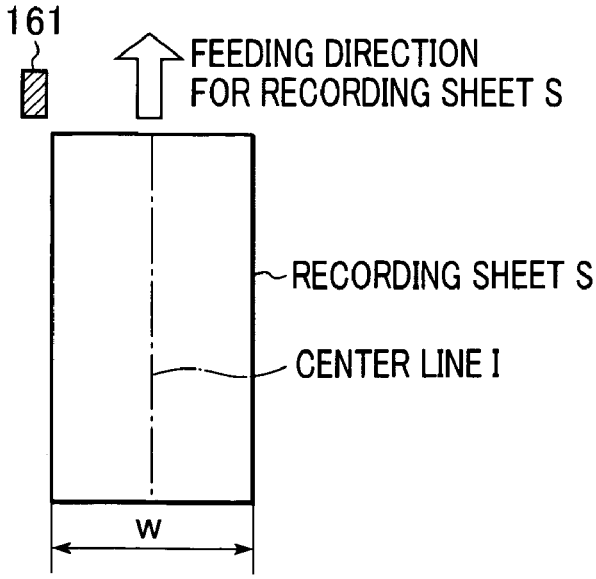
Figure 10:
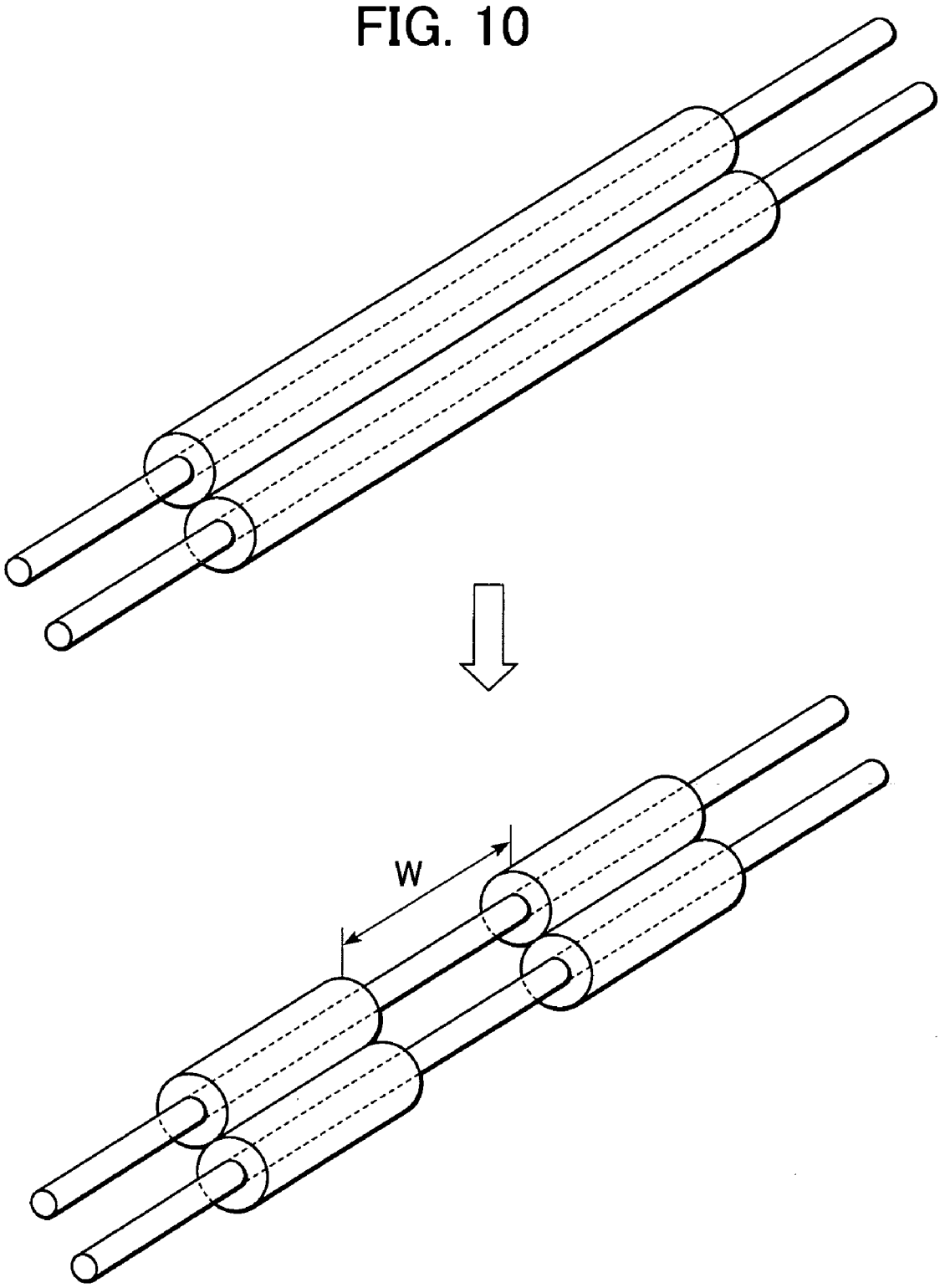
FIG. 10 is a perspective view showing the structure of a feeding roller.

The width or presence of the recording sheet S is detected, for example, by measuring the positions of both edges of the recording sheet S in the direction orthogonal to the sheet-feeding direction or by using a sensor provided at the position shown in FIG. 9 to detect the presence or absence of the recording sheet S. FIG. 9 shows the positional relationship between the recording sheet S and the sheet-width sensor 161. In this case, the sheet-width sensor 161 is disposed at such a position as to detect the edge of a recording sheet having a width corresponding to the above-described longest interval Wr in the FD feeding path. The position of the sheet-width sensor 161 is determined by the interval between the roller members of the feeding roller, that is, the interval Wr2 between the roller members in the reverse roller 202 in the second embodiment. In FIG. 9, the recording sheet S is conveyed along the center line 1.

When the width w of the recording sheet S is larger than Wr (FIG. 9A), the sheet-width sensor 161 detects the recording sheet S when the recording sheet S passes therethrough. When the width w is smaller than Wr (FIG. 9B), the sheet-width sensor 161 does not detect the recording sheet S when the recording sheet S passes therethrough. Therefore, in the structure shown in FIGS. 9A and 9B, the engine controller 126 stores in the memory information indicating whether the width of the recording sheet is larger or smaller than Wr, on the basis of the detection result by the sheet-width sensor 161.

In Step S809, the engine controller 126 monitors a signal input from an ejection sensor 208 through a sensor input unit 151, and determines whether a fixing sensor 110 detects the leading edge of the recording sheet S. When the fixing sensor 110 detects the leading edge of the recording sheet S, Step S810 is performed.

In Step S810, the engine controller 126 determines whether an FD designation or an FU designation is stored as print information in a print-information memory unit 171. When an FD designation is stored, Step S811 is performed. When an FU designation is stored, Step S814 is performed.

In Step S811, since the FD feeding path is designated as the feeding path for the recording sheet S, the engine controller 126 determines whether the size w of the recording sheet S in the sheet-feeding direction is larger than Wr stored in the memory, on the basis of the result of determination whether the recording sheet S was detected by the sheet-width sensor 161 in Step S808 (stored in the memory inside the engine controller 126). Since information indicating whether the width w of the recording sheet s is larger than Wr is stored in the case shown in FIG. 9, Step S812 is performed when w>Wr, and Step S815 is performed when w≦Wr.

In Step S812, since the width w of the recording sheet S satisfies the condition for feeding the recording sheet S in the FD feeding path, the engine controller 126 controls an FD/FU switching solenoid 205 to place an FD/FU switching flapper 212 at the position "a" in FIG. 2, and the recording sheet S is conveyed in the FD feeding path. After the recording sheet S is put in the FD feeding path, the driving of the junction roller 201 is started, and the leading edge of the recording sheet S is detected by a reverse sensor 207. After the leading edge of the recording sheet S is detected by the reverse sensor 207, the driving of the reverse roller 202 is started, and the recording sheet S is transferred from the junction roller 201 to the reverse roller 202. In synchronization with the detection of the trailing edge of the recording sheet S by the reverse sensor 207, the driving of the reverse roller 202 is temporarily stopped so that the trailing edge of the recording sheet S is placed at the point E, the feeding direction of the recording sheet S is switched from the e-direction to the opposite f-direction, and the recording sheet S is switched back.

In Step S815, since the width w of the recording sheet S is smaller than the interval Wr that allows the recording sheet to be conveyed in the FD feeding path, the engine controller 126 controls the FD/FU switching solenoid 205 to place the FD/FU switching flapper 212 at the position "b" in FIG. 2, and the recording sheet S is conveyed in the FU feeding path. Step S815 is performed only when the recording sheet S is conveyed through the FU feeding path although the FD feeding path is selected as the feeding path for the recording sheet S. Therefore, it is preferable that the engine controller 126 send, to a video controller 127, information indicating that the width w of the recording sheet S in the direction orthogonal to the sheet-feeding direction does not match the main unit 101, that is, does not match the designated feeding path. The video controller 127 can inform the user that the width w of the recording sheet S is inadequate, by displaying the information on a control panel (not shown) connected thereto or on a display screen of an external apparatus 131. In this case, the user can recognize that the width w of the recording sheet S is inadequate, and can perform an image-forming operation again after checking the width w of the recording sheet S as necessary. Such information indicating that the width w of the recording sheet S does not match the main unit 101, that is, does not match the designated feeding path may be transmitted to the video controller 127 or the like only in special cases, for example, when an ejection apparatus, such as a stapler, is connected to the main unit 101, instead of an ejection tray 112, and when trouble occurs while a plurality of recording sheets S are successively printed.

The above-described information transmission to the user can prevent, for example, the following two problems:

(1) When an ejection apparatus having a stapler is connected to the main unit 101, instead of the ejection tray 112, recording sheets that should be ejected in a face-down manner may be ejected in a face-up manner because the size of the recording sheets does not match the selected feeding path. In such a case, the recording sheets are stapled with their image-bearing surfaces facing on the side different from the designated side.

(2) When a plurality of recording sheets S are successively printed, while the preceding recording sheet S1 is passing through the FD feeding path, a succeeding recording sheet S2 that should pass through the FD feeding path passes in the FU feeding path. Consequently, the succeeding recording sheet S2 may be ejected to the ejection tray 112 earlier than the preceding recording sheet S1. In such a case, the recording sheets are stacked in the ejection tray 112 in the wrong page order.

As described above, the recording sheet S passes through the FD feeding path or the FU feeding path in Step S812, S8145, or S815, and is ejected to the ejection tray 112 by the ejection roller 204.

In Step S813, the engine controller 126 monitors a signal input from an ejection sensor 208 through the sensor input unit 151, and determines whether the ejection sensor 208 detects the trailing edge of the recording sheet S. When the ejection sensor 208 detects the trailing edge of the recording sheet S, it is determined that the recording sheet S is ejected to the ejection tray 112, and the feeding operation for the recording sheet S is completed.

As described above, in the second embodiment, even in a case in which the FD feeding path is designated for the recording sheet, when the size (width) of the recording sheet in the direction orthogonal to the sheet-feeding direction is shorter than the longest one of the intervals between the roller members of the feeding rollers provided in the FD feeding path, the recording sheet is conveyed in the FU feeding path. Therefore, it is possible to prevent the user from being troubled by jamming of the recording sheet between the roller members, for example, to eliminate the necessity of removing a jammed recording sheet.

It is also possible to precisely inform the user that the size (width) of the recording sheet in the direction orthogonal to the sheet-feeding direction does not match the main unit 101, that is, does not match the designated feeding path.

It is further possible to prevent recording sheets from being stapled with their image-bearing surfaces facing on an undesired side when an ejection apparatus having a stapler is connected to the main unit 101.

Third Embodiment

In the above-described first embodiment, in order to prevent a recording sheet from jamming, control is exerted so that the feeding path in which a recording sheet is conveyed is switched from the FD feeding path to the FU feeding path, depending on the result of comparison between the size (length) of the recording sheet in the sheet-feeding direction and the distance between the feeding rollers in the FD feeding path. In the second embodiment, such control is exerted on the basis of the result of comparison between the size (width) of a recording sheet in the direction orthogonal to the sheet-feeding direction and the intervals between the roller members of the feeding rollers.

In the third embodiment, a recording sheet is more reliably ejected without paper jamming by combining the control methods in the first and second embodiments, that is, on the basis of the length of a recording sheet in the sheet-feeding direction and the width thereof in the direction orthogonal to the sheet-feeding direction.

The third embodiments is the same as the first and second embodiments in the configuration of the apparatus and the methods for size comparison and determination, descriptions thereof are omitted.

Figure 11:
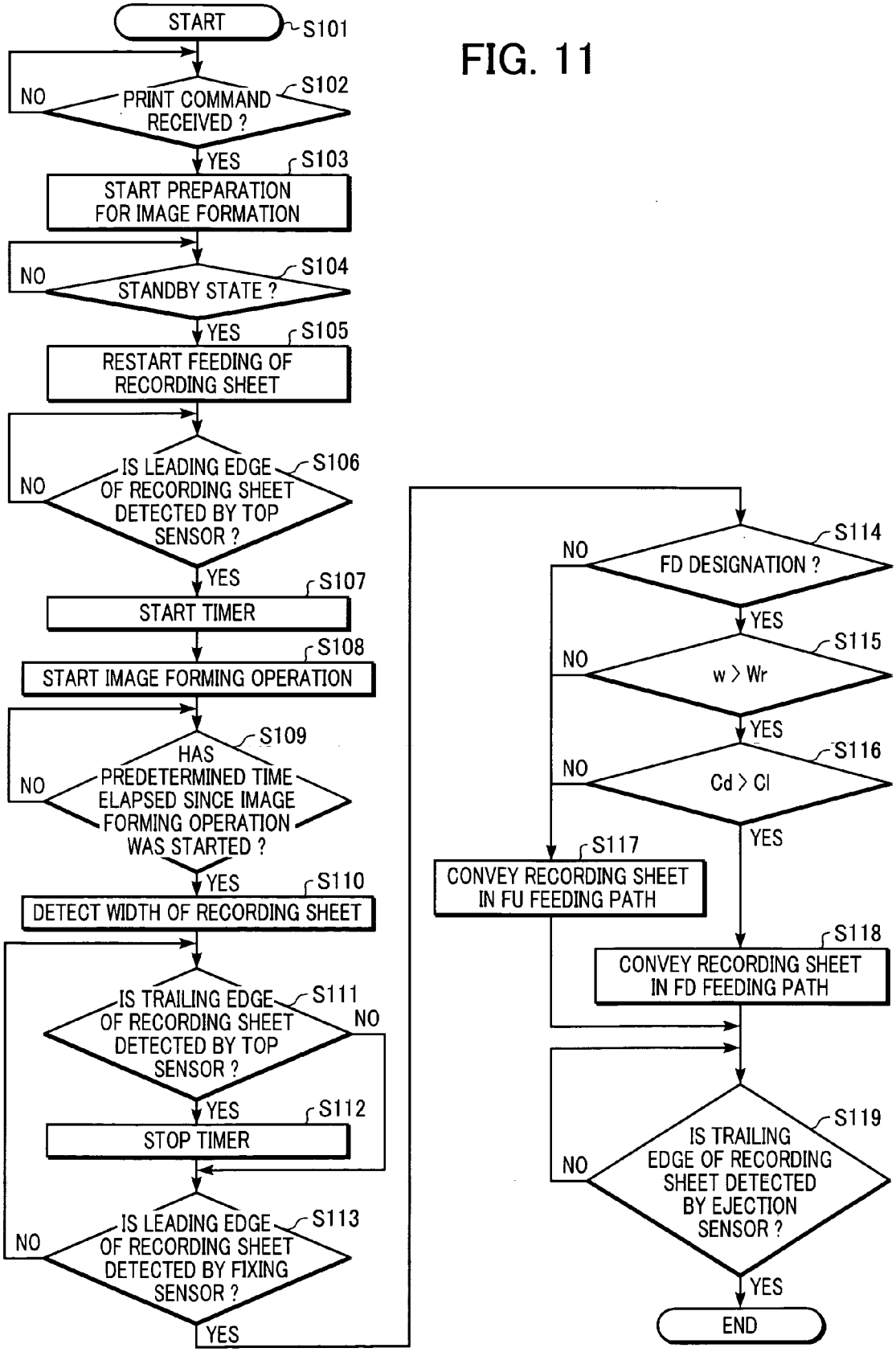
FIG. 11 is a flowchart showing the procedure for feeding a recording sheet in a third embodiment of the present invention.

The features of the third embodiment will be described in detail with reference to FIGS. 1 to 3 and FIG. 11 as a flowchart. Steps S101 to 105 in FIG. 11 are similar to Steps S601 to S605 in the first embodiment and Steps S801 to S805 in the second embodiment, descriptions thereof are omitted.

In Step S106, an engine controller 126 monitors a signal input from a top sensor 160 through a sensor input unit 151, and determines whether the top sensor 160 detects the leading edge of a recording sheet S. When the top sensor 160 detects the leading edge of the recording sheet S, Step S107 is performed.

In Step S107, the engine controller 126 starts a timer 164 to measure the length of the recording sheet S in the sheet-feeding direction.

In Step S108, the engine controller 126 starts an image-forming operation for forming an image on the recording sheet S. The image-forming operation is performed in the following procedure. First, the surface of a photoconductive drum 117 is uniformly charged by applying a charging bias to a primary charging roller 119, and an electrostatic latent image is formed by exposing the photoconductive drum 117 to laser light that is emitted from a laser scanner 107 according to image signals corresponding to a page to be printed. The electrostatic latent image on the photoconductive drum 117 is developed by a developing unit 120 to form a toner image. Subsequently, a transfer bias voltage having a polarity opposite to that of the toner is applied to a transfer roller 121, thereby forming a toner image on the recording sheet S. Furthermore, in order to thermally fix the toner image on the recording sheet S, a fixing film 109*a* and a pressure roller 109*b* are rotated while maintaining a predetermined temperature of a ceramic heater 108*c* in a fixing unit 109 on the basis of the temperature detected by a thermistor 109*d*.

In Step S109, the engine controller 126 determines with the timer 164 whether a predetermined time has elapsed since the image-forming operation was started in Step S108. When the predetermined time has elapsed, Step S110 is performed. The predetermined time refers to the sum of the time taken from when the leading edge of the recording sheet S is detected by the top sensor 160 and until when the leading edge of the recording sheet S reaches a sheet-width sensor 161, and a predetermined margin, that is, the time necessary for the sheet-width sensor 161 to reliably detect the leading edge of the recording sheet S.

In Step S110, the engine controller 126 checks whether the recording sheet S is detected by the sheet-width sensor 161. The result of detection by the sheet-width sensor 161 is stored in an internal memory (not shown) of the engine controller 126.

In Step S111, the engine controller 126 monitors a signal input from the top sensor 160 through the sensor input unit 151, and determines whether the top sensor 160 detects the trailing edge of the recording sheet S. When the top sensor 160 detects the trailing edge of the recording sheet S, Step S112 is performed. When the top sensor 160 does not detect the trailing edge of the recording sheet S, Step S113 is performed.

In Step S112, the engine controller 126 stops the counting operation of the timer 164 in response to the sensing of the trailing edge of the recording sheet S by the top sensor 160.

A value Cd counted by the timer 164 during the counting operation from Step S107 to Step S112 is stored in the internal memory of the engine controller 126 as a count value representing the size (length) d of the recording sheet S in the sheet-feeding direction.

In Step S113, the engine controller 126 monitors a signal input from a fixing sensor 110 through the sensor input unit 151, and determines whether the fixing sensor 110 detects the leading edge of the recording sheet S. When the fixing sensor 110 detects the leading edge of the recording sheet S, Step S114 is performed. When the fixing sensor 110 does not detect the leading edge, Step S111 is performed again.

In Step S114, the engine controller 126 determines whether an FD designation or an FU designation is stored as print information in a print-information memory unit 171. When an FD designation is stored, Step S115 is performed. When an FU designation is stored, Step S117 is performed.

When an FD feeding path is designated as the feeding path for the recording sheet S, the engine controller 126 determines in Step S115 whether the size (width) w of the recording sheet S in the direction orthogonal to the sheet-feeding direction is larger than Wr stored in the memory, on the basis of the result of determination whether the sheet-width sensor 161 detected the recording sheet S (the result is stored in the internal memory of the engine controller 126). In the case shown in FIG. 9, information indicating whether the width w of the recording sheet S in the direction orthogonal to the sheet-feeding direction is larger than Wr (in the third embodiment, Wr corresponds to W2 because the interval between the roller members of the reverse roller 202 is the longest, in a manner similar to that in the second embodiment) is stored. Therefore, Step S116 is performed when w>Wr, and Step S117 is performed when w≦Wr.

When the FD feeding path is designated and the width w of the recording sheet S is larger than Wr, In Step S116, the engine controller 126 determines whether the count value Cd corresponding to the length d of the recording sheet S in the sheet-feeding direction stored in the memory of the engine controller 126 in Step S112 is larger than a count value C1 prestored in the memory. The prestored count value C1 corresponds to the longest one of the distances between the rollers provided in the FD feeding path. In the configuration of a reversing unit 200 shown in FIG. 5, the distance L1 between the junction roller 201 and the reverse roller 202 is the longest, that is, is longer than the distance L2 between the reverse roller 202 and the intermediate roller 203 and the distance L3 between the intermediate roller 203 and the ejection roller 204. Therefore, in this configuration, the count value C1 corresponding to the distance L1 is stored in the memory of the engine controller 126.

When the engine controller 126 determines in Step S116 that the count value Cd corresponding to the length of the recording sheet S measured with the timer 164 is larger than the count value C1 corresponding to the distance L1 between the junction roller 201 and the reverse roller 202 in the feeding path, Step S118 is performed. When it is determined that Cd is less than or equal to C1, Step S117 is performed.

In Step S118, since the length of the recording sheet S in the sheet-feeding direction and the width in the direction orthogonal to the sheet-feeding direction satisfy the condition for feeding the recording sheet S in the FD feeding path, the engine controller 126 controls an FD/FU switching solenoid 205 to place an FD/FU flapper 212 at the position "a" in FIG. 2 so that the recording sheet S can be conveyed in the FD feeding path. After the recording sheet S is put in the FD feeding path, the driving of the junction roller 201 is started, and the leading edge of the recording sheet S is detected by a reverse sensor 207. After the leading edge of the recording sheet S is detected by the reverse sensor 207, the driving of the reverse roller 202 is started, and the recording sheet S is transferred from the junction roller 201 to the reverse roller 202. In synchronization with the detection of the trailing edge of the recording sheet S by the reverse sensor 207, the driving of the reverse roller 202 is temporarily stopped so that the trailing edge of the recording sheet S is placed at the point E, the feeding direction of the recording sheet S is switched from the e-direction to the opposite f-direction, and the recording sheet S is switched back.

In Step S117, since the length of the recording sheet S in the sheet-feeding direction or the width in the direction orthogonal to the sheet-feeding direction is shorter than the length or width that allow the recording sheet to be conveyed in the FD feeding path, the engine controller 126 controls the FD/FU switching solenoid 205 to place the FD/FU switching flapper 212 at the position "b" in FIG. 2, and the recording sheet S is conveyed in the FU feeding path.

Step S117 is performed on the result of the determination made in Step S115 or Step S116 only when the recording sheet S is conveyed through the FU feeding path although the FD feeding path is selected as the feeding path for the recording sheet S. Therefore, it is preferable that the engine controller 126 send, to a video controller 127, information indicating that the length or width of the recording sheet S does not match the main unit 101, that is, does not match the designated feeding path. The video controller 127 can inform the user that the length or width of the recording sheet S is inadequate, by displaying the information on a control panel (not shown) connected thereto or on a display screen of the external apparatus 131. In this case, the user can recognize that the length or width of the recording sheet S is inadequate, and can perform an image-forming operation again after checking the length or width of the recording sheet S in the sheet-feeding direction as necessary. Such information indicating that the length or width of the recording sheet S does not match the main unit 101, that is, does not match the designated feeding path may be transmitted to the video controller 127 or the like only in special cases, for example, when an ejection apparatus, such as a stapler, is connected to the main unit 101, instead of an ejection tray 112, and when trouble occurs while a plurality of recording sheets S are successively printed.

The above-described information transmission to the user can prevent, for example, the following two problems:

(1) When an ejection apparatus having a stapler is connected to the main unit 101, instead of the ejection tray 112, recording sheets that should be ejected in a face-down manner may be ejected in a face-up manner because the size of the recording sheets does not match the selected feeding unit. In such a case, the recording sheets are stapled with their image-bearing surfaces facing on the side different from the designated side.

(2) When a plurality of recording sheets S are successively printed, while the preceding recording sheet S1 is passing in the FD feeding path, a succeeding recording sheet S2 that should pass in the FD feeding path passes in the FU feeding path. Consequently, the succeeding recording sheet S2 may be ejected to the ejection tray 112 earlier than the preceding recording sheet S1. In such a case, the recording sheets are stacked in the ejection tray 112 in the wrong page order.

As described above, the recording sheet S passes in the FD feeding path or the FU feeding path in Step S117 or S118, and is ejected to the ejection tray 112 by the ejection roller 204.

In Step S119, the engine controller 126 monitors a signal input from an ejection sensor 208 through the sensor input unit 151, and determines whether the ejection sensor 208 detects the trailing edge of the recording sheet S. When the ejection sensor 208 detects the trailing edge of the recording sheet S, it is determined that the recording sheet S is ejected to the ejection tray 112, and the feeding operation for the recording sheet S is completed.

As described above, in the third embodiment, even in a case in which the FD feeding path is selected for the recording sheet, the recording sheet is fed in the FU feeding path, depending on the size (length) of the recording sheet in the sheet-feeding direction and the size (width) in the direction orthogonal to the sheet-feeding direction. Therefore, it is possible to prevent the user from being troubled by jamming of the recording sheet between the rollers, for example, to eliminate the necessity of removing a jammed recording sheet.

It is also possible to precisely inform the user that the length or width of the recording sheet does not match the main unit 101, that is, does not match the designated feeding path.

It is further possible to prevent recording sheets from being stapled with their image-bearing surfaces facing on the side different from the designated side when an ejection apparatus having a stapler is connected to the main unit 101.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

an image forming unit for forming an image on a recording medium;

a first feeding path through which the recording medium from the image forming unit passes;

a second feeding path through which the recording medium from the image forming unit passes;

a feeding unit for feeding the recording medium in the second feeding path, the feeding unit including a first feeding member and a second feeding member with an interval disposed therebetween, wherein the first feeding member and the second feeding member operate in contact with the recording medium;

a switching unit for switching between the first feeding path and the second feeding path to feed the recording medium; and a control unit for feeding the recording medium through the first feeding path when a size of the recording medium in a direction orthogonal to a sheet-feeding direction is smaller than the interval between the first feeding member and the second feeding member even when the second feeding path is selected to feed the recording medium.

2. The image forming apparatus according to claim 1, the feeding unit comprising a plurality of feeding units provided at different positions in the second feeding path, and wherein the control unit feeds the recording medium through the first feeding path when the size of the recording medium is smaller than the longest one of the intervals of the feeding units.

3. The image forming apparatus according to claim 1, wherein the feeding unit is a feeding roller unit, and the first feeding member and the second feeding member are roller members provided on a shaft of the feeding roller unit.

4. The image forming apparatus according to claim 1, wherein the control unit outputs information indicating that the size of the recording medium does not match the second feeding path when the size of the recording medium is smaller than the interval.

5. The image forming apparatus according to claim 1, further comprising:

an ejection unit for ejecting the recording medium, wherein the recording medium is conveyed to the ejection unit with an image bearing surface facing up through the first feeding path, or with the image bearing surface facing down through the second feeding path.

6. An image forming apparatus comprising:

an image forming unit for forming an image on a recording medium;

a first feeding path through which the recording medium from the image forming unit passes;

a second feeding path through which the recording from the image forming unit passes;

a plurality of feeding units for feeding the recording medium in the second feeding path, each feeding unit including a first feeding member and a second feeding member with an interval disposed therebetween, wherein the first feeding member and the second feeding member operate in contact with the recording medium;

a switching unit for switching between the first feeding path and the second feeding path to feed the recording medium; and a control unit for feeding the recording medium through the first feeding path when a size of the recording medium in a direction orthogonal to a sheet feeding direction is smaller than the interval between the first feeding member and the second feeding member of one of a plurality of feeding units, and when a size of the recording medium in the sheet feeding direction is smaller than a distance between the feeding units even when the second feeding path is selected to feed the recording medium.

7. The image forming apparatus according to claim 6, wherein the feeding unit is a feeding roller unit, and the first feeding member and the second feeding member are roller members provided on a shaft of the feeding roller unit.

8. The image forming apparatus according to claim 6, wherein the control unit outputs information indicating that at least one of the sizes of the recording medium do not match the second feeding path when the size of the recording medium in a direction orthogonal to a sheet feeding direction is smaller than the interval, and when the size of the recording medium in the sheet feeding direction is smaller than a distance between the feeding units.

9. The image forming apparatus according to claim 6, further comprising:

an ejection unit for ejecting the recording medium, wherein the recording medium is conveyed to the ejection unit with an image bearing surface facing up through the first feeding path, or with the image bearing surface facing down through the second feeding path.

10. An image forming apparatus comprising:

an image forming portion for forming an image on a recording medium;

a first transferring path through which the recording medium from the image forming portion passes;

a second transferring path through which the recording medium from the image forming portion passes;

a transferring portion for transferring the recording medium in the second transferring path, the transferring portion including a first transferring member and a second transferring member with an interval disposed therebetween, wherein the first transferring member and the second transferring member operate in contact with the recording medium;

a switching portion for switching between the first transferring path and the second transferring path to transfer the recording medium; and a control portion for controlling to transfer the recording medium to the first transferring path when a size of the recording medium in a direction orthogonal to a recording medium transferring direction is smaller than the interval between the first transferring member and the second transferring member even when the second transferring path is selected to transfer the recording medium.

11. The image forming apparatus according to claim 10, further comprising a plurality of the transferring portions, and wherein the control portion transfers the recording medium through the first transferring path when the size of the recording medium is smaller than one of the intervals provided in the plurality of transferring portions.

12. The image forming apparatus according to claim 10, wherein the transferring portion is a roller unit, and the first transferring member and the second transferring member each comprise a pair of rollers forming a nip.

13. The image forming apparatus according to claim 10, wherein the control portion outputs information indicating that the size of the recording medium does not match the second transferring path when the size of the recording medium is smaller than the interval.

14. The image forming apparatus according to claim 10, further comprising:

an ejection portion for ejecting the recording medium, wherein the recording medium is conveyed to the ejection portion with an image bearing surface facing up through the first transferring path, or with the image bearing surface facing down through the second transferring path.

15. An image forming apparatus comprising:

an image forming portion for forming an image on a recording medium;

a first transferring path through which the recording medium from the image forming portion passes;

a second transferring path through which the recording from the image forming portion passes;

a plurality of transferring portions for transferring the recording medium in the second transferring path, and each transferring portion including a first transferring member and a second transferring member with a interval disposed therebetween, wherein the first transferring member and the second transferring member operate in contact with the recording medium;

a switching portion for switching between the first transferring path and the second transferring path to feed the recording medium; and a control portion for controlling to transfer the recording medium to the first transferring path when a size of the recording medium in a direction orthogonal to a recording medium transferring direction is smaller than one of intervals between the first feeding member and the second feeding member of one of the plurality of transferring portions, and when a size of the recording medium in the recording medium transferring direction is smaller than a distance between the transferring portions even when the second transferring path is selected to transfer the recording medium.

16. The image forming apparatus according to claim 15, wherein the transferring portions are roller units, and the first transferring member and the second transferring member each comprising a pair of rollers forming a nip.

17. The image forming apparatus according to claim 15, wherein the control portion outputs information indicating that at least one of the sizes of the recording medium do not match the second feeding path when the size of the recording medium in a direction orthogonal to a recording medium transferring direction is smaller than the interval, and when the size of the recording medium in the recording medium transferring direction is smaller than a distance between the transferring units.

18. The image forming apparatus according to claim 15, further comprising:

an ejection portion for ejecting the recording medium, wherein the recording medium is conveyed to the ejection portion with an image bearing surface facing up through the first transferring path, or with the image bearing surface facing down through the second transferring path.

* * * * *